US011069275B2

(12) United States Patent
Chen et al.

(10) Patent No.: US 11,069,275 B2
(45) Date of Patent: Jul. 20, 2021

(54) TIMING CONTROLLER HAVING DETECTION CIRCUIT AND CONTROL CIRCUIT, AND DRIVING METHOD AND DISPLAY DEVICE THEREOF

(71) Applicants: Hefei Xinsheng Optoelectronics Technology Co., Ltd., Anhui (CN); BOE Technology Group Co., Ltd., Beijing (CN)

(72) Inventors: Kangxi Chen, Beijing (CN); Shuai Liu, Beijing (CN); Xianfeng Yuan, Beijing (CN); Min Wang, Beijing (CN); Yuanyuan Liu, Beijing (CN); Zejun Chen, Beijing (CN)

(73) Assignees: Hefei Xinsheng Optoelectronics Technology Co., Ltd., Hefei (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/655,352

(22) Filed: Oct. 17, 2019

(65) Prior Publication Data

US 2020/0135082 A1 Apr. 30, 2020

(30) Foreign Application Priority Data

Oct. 29, 2018 (CN) ..... 201811265789.8

(51) Int. Cl.
*G09G 3/20* (2006.01)

(52) U.S. Cl.
CPC ..... *G09G 3/20* (2013.01); *G09G 2310/08* (2013.01); *G09G 2330/06* (2013.01)

(58) Field of Classification Search
CPC .. G09G 3/20; G09G 2310/08; G09G 2330/06; G09G 2370/08; G09G 2370/00; G09G 2330/028
See application file for complete search history.

(56) References Cited

U.S. PATENT DOCUMENTS

2012/0166896 A1 6/2012 Oh et al.
2013/0076703 A1 3/2013 Baek et al.
(Continued)

FOREIGN PATENT DOCUMENTS

CN 102542974 A 7/2012
CN 103021313 A 4/2013
(Continued)

OTHER PUBLICATIONS

First office action of Chinese application No. 201811265789.8 dated Apr. 2, 2021.

*Primary Examiner* — Rodney Amadiz
(74) *Attorney, Agent, or Firm* — Fay Sharpe LLP

(57) ABSTRACT

Provided are a timing controller, and a driving method and a display device thereof. The timing controller may include a detection circuit and a control circuit. The detection circuit may detect a symbol error rate of a drive signal transmitted from a control circuit to a source drive circuit, and send the symbol error rate to the control circuit. The control circuit may automatically adjust a voltage swing of the drive signal according to the symbol error rate of the drive signal, and may enable a magnitude of the adjusted voltage swing to negatively correlate with a magnitude of the symbol error rate. Therefore, electromagnetic interference is effectively reduced, and flexibility in reducing electromagnetic interference is improved.

18 Claims, 9 Drawing Sheets

(56) References Cited

U.S. PATENT DOCUMENTS

| | | | | |
|---|---|---|---|---|
| 2014/0118377 | A1 | 5/2014 | Bae et al. | |
| 2016/0125782 | A1 | 5/2016 | Park et al. | |
| 2016/0217759 | A1 | 7/2016 | Morita | |
| 2016/0372084 | A1 | 12/2016 | Wang | |
| 2017/0193922 | A1* | 7/2017 | Pyeon | G09G 3/3266 |

FOREIGN PATENT DOCUMENTS

| | | | |
|---|---|---|---|
| CN | 103489392 | A | 1/2014 |
| CN | 103794168 | A | 5/2014 |
| CN | 104505017 | A | 4/2015 |
| CN | 105321479 | A | 2/2016 |
| CN | 106935188 | A | 7/2017 |
| CN | 107612306 | A | 1/2018 |
| CN | 107707251 | A | 2/2018 |
| CN | 107731190 | A | 2/2018 |
| CN | 108022546 | A | 5/2018 |
| WO | WO 2016200191 | A1 | 12/2016 |

* cited by examiner

TIMING CONTROLLER HAVING DETECTION CIRCUIT AND CONTROL CIRCUIT, AND DRIVING METHOD AND DISPLAY DEVICE THEREOF

CROSS-REFERENCE TO RELATED APPLICATION

This application claims priority to Chinese Patent Application No. 201811265789.8, filed on Oct. 29, 2018 and entitled "TIMING CONTROLLER, DRIVING METHOD AND DISPLAY DEVICE THEREOF", the entire contents of which are incorporated herein by reference.

TECHNICAL FIELD

The present disclosure relates to the field of display technologies, and in particular, relates to a timing controller, and a driving method and a display device thereof.

BACKGROUND

With the development of display technologies, more and more types of electronic devices are coming into people's life. When an electronic device with a high transmit power is operating in the vicinity of a display device, electromagnetic interference (EMI) may be caused to the display device. For example, under the EMI, a control signal output from a drive circuit of the display device to a display panel may encounter an abnormality, which may affect a display effect of the display device.

SUMMARY

The present disclosure provides a timing controller, and a driving method and a display device thereof.

At least one embodiment of the present disclosure provides a timing controller. The timing controller includes: a detection circuit and a control circuit, wherein the control circuit is connected to a source drive circuit, and the detection circuit is connected to the source drive circuit and the control circuit respectively.

The control circuit is configured to transmit a drive signal to the source drive circuit.

The detection circuit is configured to detect a symbol error rate of the drive signal.

The control circuit is further configured to adjust a voltage swing of the drive signal according to a symbol error rate detected by the detection circuit, wherein a magnitude of the voltage swing of the drive signal is negatively correlated with a magnitude of the symbol error rate, and the voltage swing of the drive signal refers to a maximum value and a minimum voltage of a voltage of the drive signal.

Optionally, the detection circuit includes an operation sub-circuit and a counter sub-circuit.

A first input terminal of the operation sub-circuit is connected to an output terminal of the control circuit, a second input terminal of the operation sub-circuit is connected to an input terminal of the source drive circuit, an output terminal of the operation sub-circuit is connected to the counter sub-circuit, and the counter sub-circuit is further connected to an input terminal of the control circuit.

The operation sub-circuit is configured to perform a logic operation on a drive signal outputted from the output terminal of the control circuit and a drive signal received from the input terminal of the source drive circuit, and send an operation result of the logic operation to the counter sub-circuit.

The counter sub-circuit is configured to determine a symbol error rate of the drive signal according to the operation result, and send the symbol error rate to the input terminal of the control circuit.

Optionally, the operation sub-circuit is an exclusive OR logic sub-circuit.

Optionally, the control circuit includes a voltage regulation sub-circuit and a drive sub-circuit.

The voltage regulation sub-circuit is connected to the detection circuit and the drive sub-circuit respectively, and the drive sub-circuit is connected to the source drive circuit.

The voltage regulation sub-circuit is configured to regulate an operating voltage applied to the drive sub-circuit according to the symbol error rate, wherein a magnitude of the operating voltage is negatively correlated with a magnitude of the symbol error rate.

The drive sub-circuit is configured to adjust a voltage swing of the output drive signal according to the operating voltage, wherein a magnitude of the voltage swing of the drive signal is positively correlated with a magnitude of the operating voltage.

Optionally, the voltage regulation sub-circuit includes a control module, a plurality of resistors connected in series, and a plurality of switching transistors one-to-one corresponding to the plurality of resistors connected in series.

The control module is connected to the detection circuit and a gate of each of the switching transistors respectively; one terminals of the plurality of resistors connected in series are connected to a first power supply terminal, and the other terminals of the plurality of resistors connected in series are connected to a second power supply terminal; and a first pole of each of the switching transistors is connected to one terminal of a corresponding one of the resistors, and a second pole of each of the switching transistors is connected to the drive sub-circuit.

The control module is configured to control an operating state of each of the switching transistors according to the symbol error rate.

Optionally, the voltage regulation sub-circuit includes a control module, a plurality of resistors connected in parallel, and a plurality of switching transistors one-to-one corresponding to the plurality of resistors connected in parallel.

The control module is connected to the detection circuit and a gate of each of the switching transistors respectively; one terminal of each of the plurality of resistors connected in parallel is connected between the first power supply terminal and the second power supply terminal, and the first power supply terminal is connected to the second power supply terminal; and a first pole of each of the switching transistors is connected to the other terminal of a corresponding one of the resistors, and a second pole of each of the switching transistors is connected to the drive sub-circuit.

The control module is configured to control an operating state of each of the switching transistors according to the symbol error rate.

Optionally, the voltage regulation sub-circuit includes five resistors and five switching transistors one-to-one corresponding to the five resistors.

Optionally, the detection circuit is further configured to send the symbol error rate to the source drive circuit, and the source drive circuit is configured to send a hold signal to the control circuit according to the symbol error rate.

The control circuit is further configured to adjust a voltage swing of the drive signal according to a symbol error rate detected by the detection circuit when a potential of the hold signal is an effective potential, and inhibit an adjustment to the voltage swing of the drive signal when a potential of the hold signal is an ineffective potential.

At least one embodiment of the present disclosure provides a driving method of a timing controller. The method includes:

detecting a symbol error rate of a drive signal transmitted to a source drive circuit;

adjusting a voltage swing of the drive signal according to the symbol error rate, wherein a magnitude of the voltage swing of the drive signal is negatively correlated with a magnitude of the symbol error rate, and the voltage swing of the drive signal refers to the maximum value and the minimum value of a voltage of the drive signal.

Optionally, the detecting a symbol error rate of a drive signal transmitted to a source drive circuit includes:

performing a logic operation on a drive signal outputted by the timing controller and a drive signal received by the source drive circuit; and determining the symbol error rate of the drive signal according to an operation result.

Optionally, prior to the adjusting the voltage swing of the drive signal according to the symbol error rate, the method further includes:

receiving a hold signal sent by the source drive circuit; and the adjusting the voltage swing of the drive signal according to the symbol error rate includes:

adjusting the voltage swing of the drive signal according to the symbol error rate when the received potential of the hold signal is an effective potential.

The method further includes: inhibiting an adjustment to the voltage swing of the drive signal when the received potential of the hold signal is an ineffective potential.

Optionally, the detecting a symbol error rate of a drive signal transmitted to the source drive circuit includes:

in a blank phase, detecting a symbol error rate of a drive signal transmitted to the source drive circuit; and the adjusting the voltage swing of the drive signal according to the symbol error rate includes:

in the blank phase, adjusting the voltage swing of the drive signal according to the symbol error rate;

wherein in the blank phase, the source drive circuit is in a hold state, and the source drive circuit controls the display panel to display a previous frame image.

Optionally, before the blank phase ends, the method further includes:

detecting whether a symbol error rate of the drive signal is greater than a symbol error rate threshold: and when the symbol error rate of the drive signal is greater than the symbol error rate threshold, sending a control signal to the source drive circuit, and continuing to adjust the voltage swing of the drive signal according to the symbol error rate;

wherein the control signal is intended to indicate that the source drive circuit is in the hold state in a display phase after the blank phase.

Optionally, the adjusting the voltage swing of the drive signal according to the symbol error rate includes:

detecting whether the symbol error rate of the drive signal is greater than the symbol error rate threshold: and when the symbol error rate of the drive signal is greater than the symbol error rate threshold, adjusting the voltage swing of the drive signal according to the symbol error rate.

At least one embodiment of the present disclosure provides a display device. The display device includes the timing controller according to the above aspect.

DETAILED DESCRIPTION

Figure 1:
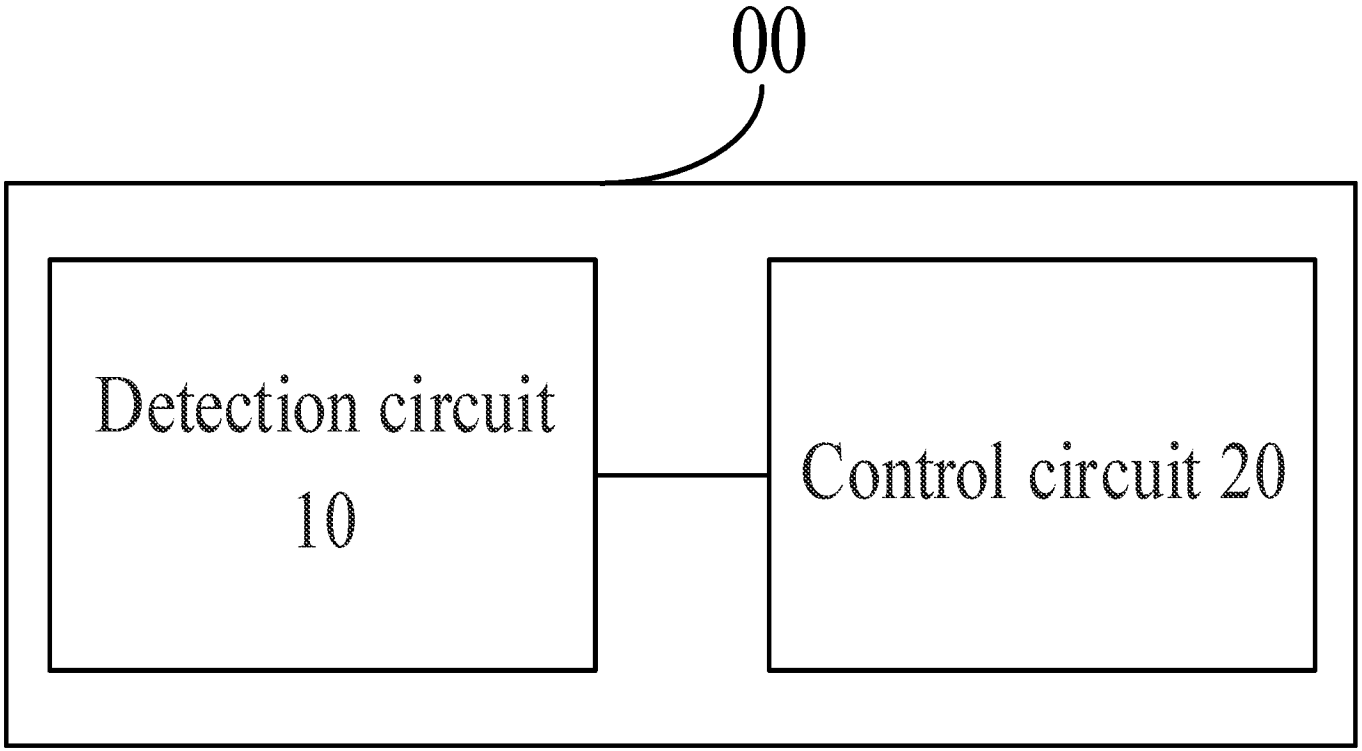
FIG. 1 is a schematic structural diagram of a timing controller according to an embodiment of the present disclosure.

The present disclosure is described in further detail hereinafter with reference to the accompanying drawings, to present the objects, technical solutions, and advantages of the present disclosure more clearly.

Transistors employed in all the embodiments of the present disclosure may each be a thin film transistor or a field effect transistor or another device with the same characteristics, and the transistors employed in the embodiments of the present disclosure are mainly switching transistors according to functionality in a circuit. Since sources and drains of the switching transistors used herein are symmetrical, and the sources and the drains of the switching transistors are interchangeable. In the embodiments of the present disclosure, the sources are referred to as first poles and the drains are referred to as second poles. According to morphology in the accompanying drawings, it is defined that middle terminals of the transistors serve as gates, signal input terminals serve as the sources, and signal output terminals serve as the drains. In addition, the switching transistor employed in the embodiments of the present disclosure may include either a P-type switching transistor or an N-type switching transistor, wherein the P-type switching transistor is turned on when the gate is at a low level, and turned off when the gate is at a high level. The N-type switching transistor is turned on when the gate is at a high level and turned off when the gate is at a low level. In addition, a plurality of signals in the various embodiments of the present disclosure correspond to a first potential and a second potential, and the first potential and the second potential only represent that the potentials of the signals have two different state quantities, rather than representing that the first potential or the second potential has a specific value herein.

As the resolution ratio of the display device becomes higher and higher, requirements for a clock frequency of a digital signal get increasingly high, and accordingly, requirements for a signal transmission rate between a timing controller and a source drive circuit is further increasing. At present, instead of a mini low voltage differential signaling (Mini-LVDS) technology of transmitting a signal at a low speed, a peer-to-peer (P2P) technology of transmitting a signal at a high speed is generally adopted is generally adopted to implement signal transmission between the timing controller and the source drive circuit.

However, since a transmission rate when the signal is transmitted by the P2P technology is relatively high, when the electronic device with a high transmit power is close to the display device that transmits the signal by the P2P technology, EMI may be caused to a drive signal transmitted to the source drive circuit by the timing controller of the display device. The drive signal received by the source drive circuit may have a symbol error, that is, the source drive circuit may not receive a correct drive signal. When the source drive circuit drives, according to the erroneous drive signal, a display panel to operate, distortion may be caused to an image displayed by the display panel, and thus the display effect of the display device is affected.

In the related art, generally, the impacts of the EMI on the display effect may be reduced by attaching a shielding material with an EMI shielding effect to a binding area of the display device; or a voltage swing of the drive signal transmitted to the source drive circuit by the timing controller may be artificially reduced during testing, such that a peak value of the drive signal transmitted to the source drive circuit becomes more gradual, and the anti-EMI characteristic of the display device is enhanced. However, attaching the shielding material may increase the production cost, the manufacturing procedure and the manufacturing difficulty of the display device. Artificially reducing the voltage swing of the drive signal is less flexible, which may cause noise after the display device is used for a long time.

Embodiments of the present disclosure provide a timing controller that may reduce the of the timing controller without additionally increasing the production cost. As illustrated in FIG. 1, the timing controller 00 may include a detection circuit 10 and a control circuit 20. The control circuit 20 may be connected to a source drive circuit (not illustrated in FIG. 1) and transmits a drive signal to the source drive circuit.

The detection circuit 10 may be connected to the source drive circuit and the control circuit 20 respectively, and the detection circuit 10 may detect a symbol error rate of the drive signal.

The symbol error rate (SER) of the drive signal may refer to a ratio of the number of symbols which are erroneous (i.e., the number of symbol errors) in the drive signal received by the source drive circuit within a preset time period to the total number of symbols of the drive signal transmitted to the source drive circuit by the control circuit 20. The preset time period may be a time period preset by the timing controller or a time period preset by a user, which is not limited in the embodiment of the present disclosure.

In the embodiment of the present disclosure, the detection circuit 10 may detect whether the drive signal transmitted by the control circuit 20 to the source drive circuit is the same as the drive signal received by the source drive circuit within the preset time period. For example, the detection circuit 10 may detect whether at least one parameter of parameters such as magnitudes, frequencies, or phases of the drive signal transmitted by the control circuit 20 and the drive signal received by the source drive circuit is the same. When the detection circuit 10 detects that any one parameter in the drive signal received by the source drive circuit and the drive signals transmitted by the control circuit 20 is different, it may be determined that the drive signal has a symbol error. Further, the detection circuit 10 may calculate the symbol error rate of the drive signal according to the detected number of symbol errors and the total number of symbols of the drive signal transmitted by the control circuit 20.

The control circuit 20 may further adjust the voltage swing of the drive signal according to the symbol error rate detected by the detection circuit 10. A magnitude of the adjusted voltage swing of the drive signal is negatively correlated with a magnitude of the symbol error rate. That is, the larger the symbol error rate, the smaller the adjusted voltage swing of the drive signal; and the smaller the symbol error rate, the larger the adjusted voltage swing of the drive signal.

Here, the drive signal is positively or negatively transformed, the transformation of the voltage between the minimum value and the maximum value is referred to as a swing, and the voltage swing refers to a maximum value and a minimum value of the voltage of the drive signal. Comparing the magnitudes of different voltage swings is to compare magnitudes of the minimum values and magnitudes of the maximum values of different voltage swings respectively. The larger the symbol error rate, the smaller the maximum value and the minimum value of the voltage of the drive signal. The smaller the symbol error rate, the larger the maximum value and the minimum value of the voltage of the drive signal. For example, the first symbol error rate is greater than the second symbol error rate, the maximum value of the drive signal at the first symbol error rate is smaller than the maximum value of the drive signal at the second symbol error rate, and the minimum value of the drive signal at the first symbol error rate is smaller than the minimum value of the drive signal at the second symbol error rate.

In the embodiment of the present disclosure, the detection circuit 10 may transmit the detected symbol error rate to the control circuit 20, and further the control circuit 20 may automatically adjust the voltage swing of the drive signal according to the received symbol error rate. Moreover, when the received symbol error rate is relatively large, the control circuit 20 may correspondingly reduce the voltage swing of the drive signal. The larger the symbol error rate, the less gradual the peak value of the drive signal, and therefore, the weaker the anti-EMI capability. At this time, the peak value of the drive signal may be made more gradual by reducing the voltage swing of the drive signal, such that its anti-EMI capability is improved. When the received symbol error rate is relatively small, the control circuit 20 may correspondingly increase the voltage swing of the drive signal. The smaller the symbol error rate, the more gradual the peak value of the drive signal, and therefore, noise interference may be caused. At this time, the peak value of the drive signal may be made less gradual by increasing the voltage swing of the drive signal, and thus the noise interference may be avoided, and the anti-noise interference capability is enhanced.

In summary, the present disclosure provides a timing controller. The timing controller may include a detection circuit and a control circuit. The detection circuit may detect a symbol error rate of the drive signal transmitted to the source drive circuit by the control circuit, and send the symbol error rate to the control circuit. The control circuit may automatically adjust a voltage swing of the drive signal according to the symbol error rate of the drive signal, and may enable a magnitude of the adjusted voltage swing to negatively correlate with a magnitude of the symbol error rate. Therefore, the electromagnetic interference is effectively reduced, and the flexibility in reducing the electromagnetic interference is improved.

Figure 2:
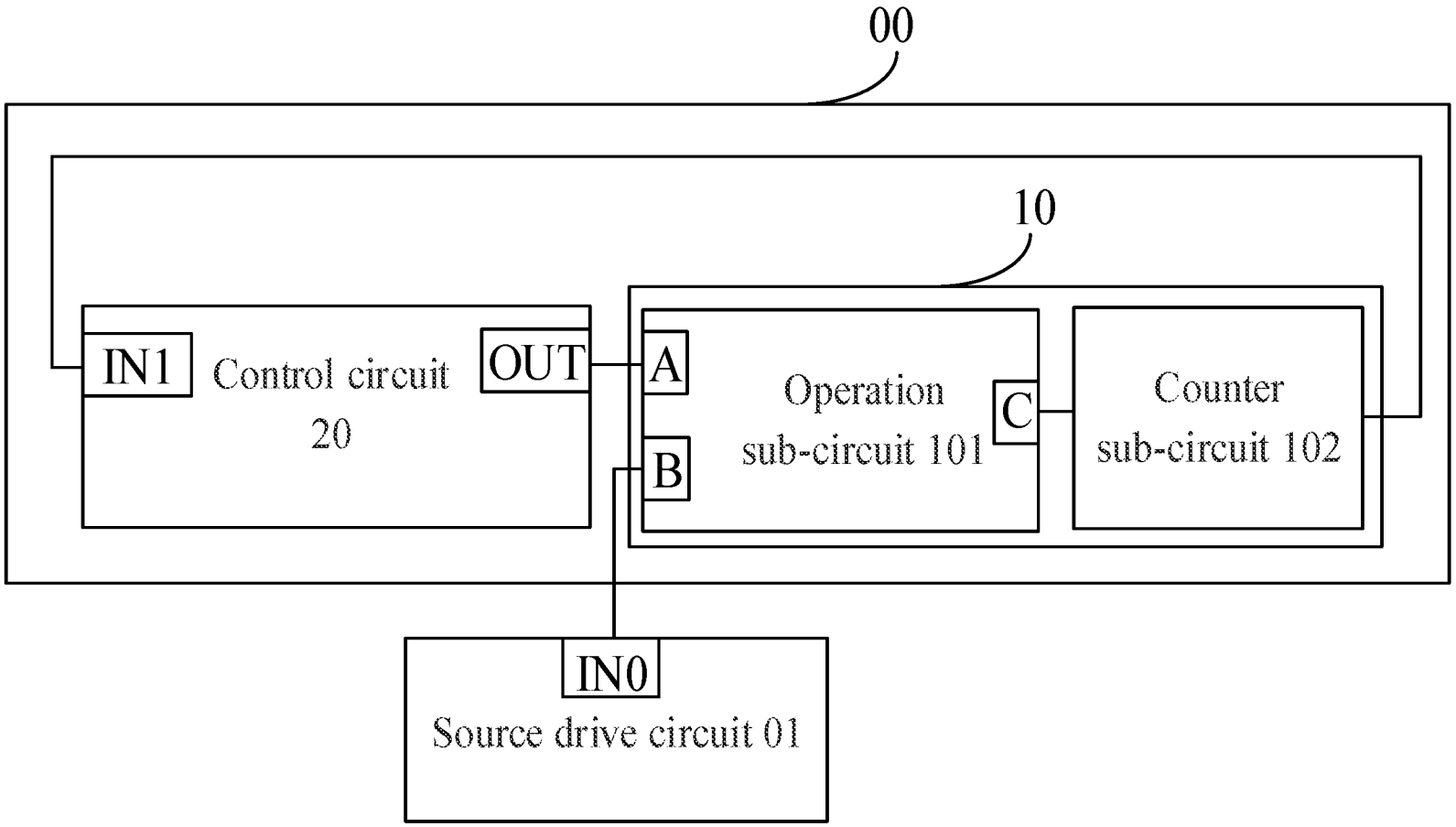
FIG. 2 is a schematic structural diagram of another timing controller according to an embodiment of the present disclosure.

FIG. 2 is a schematic diagram showing a structure of another timing controller 00 according to an embodiment of the present disclosure. As illustrated in FIG. 2, the detection circuit 10 may include an operation sub-circuit 101 and a counter sub-circuit 102.

A first input terminal A of the operation sub-circuit 101 may be connected to an output terminal OUT of the control circuit 20, and a second input terminal B of the operation sub-circuit 101 may be connected to an input terminal IN0 of the source drive circuit 01. An output terminal C of the operation sub-circuit 101 may be connected to the counter sub-circuit 102. The operation sub-circuit 101 may perform a logic operation on a drive signal outputted from the output terminal OUT of the control circuit 20 and a drive signal received from the input terminal IN0 of the source drive circuit 01, and send an operation result of the logic operation to the counter sub-circuit 102.

The counter sub-circuit 102 may further be connected to the input terminal IN1 of the control circuit 20, and the counter sub-circuit 102 may determine a symbol error rate of the drive signal according to the operation result, and send the symbol error rate to the control circuit 20.

In the embodiment of the present disclosure, whether the drive signal has a symbol error or not is automatically detected by performing, by the operation sub-circuit 101, the logic operation on the drive signal transmitted to the source drive circuit by the control circuit 20 and the drive signal received by the source drive circuit; and the number of symbol errors is determined by accumulating, by the counter sub-circuit 102, the operation results sent by the operation sub-circuit 101 according to a symbol error condition. In this way, automatic detection of the number of symbol errors is implemented, and automatic detection of the symbol error rate is further practiced.

Figure 3:
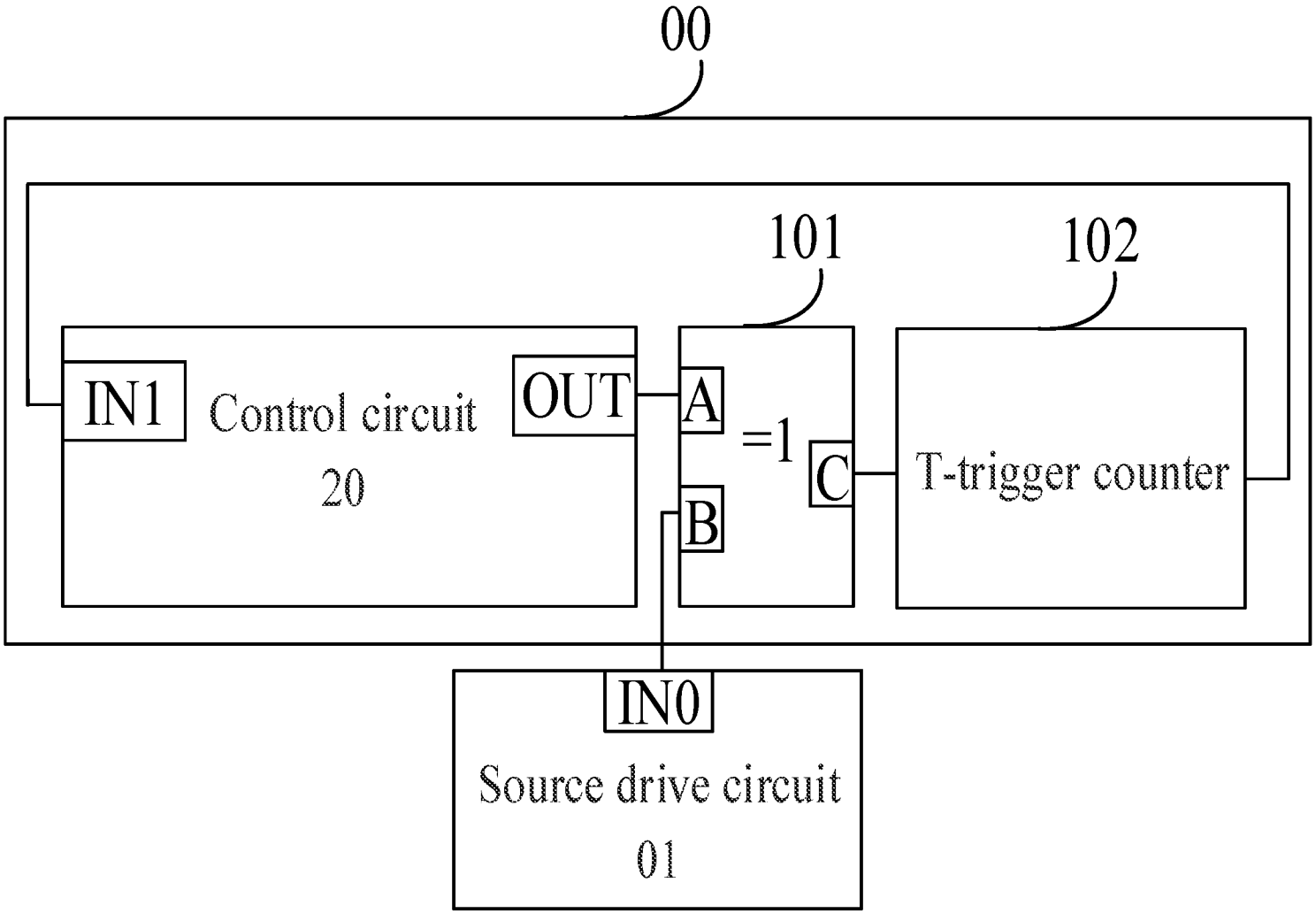
FIG. 3 is a schematic structural diagram still another timing controller according to an embodiment of the present disclosure.

Optionally, FIG. 3 is a schematic diagram showing a structure of further timing controller according to an embodiment of the present disclosure. As illustrated in FIG. 3, the operation sub-circuit 101 according to the embodiment of the present disclosure may be an exclusive OR logic sub-circuit, and the counter sub-circuit 102 may be a T-trigger counter.

As can be seen from an operation logic of the exclusive OR logic sub-circuit, when a signal received by a first input terminal A of the operation sub-circuit 101 is 0, a signal received by a second input terminal B is 1, that is, when the signal received by the first input terminal A and the signal received by the second input terminal B are different, an operation result outputted from an output terminal C to the counter sub-circuit 102 is 1. When the signal received by the first input terminal A of the operation sub-circuit 101 is 1, the signal received by the second input terminal B is 1, that is, the signal received by the first input terminal A of the operation sub-circuit 101 and the signal received by the second input terminal B are the same, the operation result outputted from the output terminal C to the counter sub-circuit 102 is 0.

In the embodiment of the present disclosure, the first input terminal A of the operation sub-circuit 101 is connected to the output terminal OUT of the control circuit 20, and the second input terminal B is connected to the input terminal IN0 of the source drive circuit 01. Therefore, when the drive signal transmitted to the source drive circuit 01 by the control circuit 20 is different from the drive signal received by the source drive circuit 01 (that is, when the drive signal has a symbol error), the operation sub-circuit 101 may output 1 to the counter sub-circuit 102. When the drive signal transmitted to the source drive circuit 01 by the control circuit 20 is the same as the drive signal received by the source drive circuit 01 (that is, when the drive signal has no symbol error), the operation sub-circuit 101 may output 0 to the counter sub-circuit 102. Further, the counter sub-circuit 102 may accumulate the received operation result to obtain the number of symbol errors, and further may determine the symbol error rate according to the calculated number of symbol errors.

Optionally, in the embodiment of the present disclosure, after determining the number of symbol errors, the counter sub-circuit 102 may send the number of symbol errors directly to the control circuit 20. The control circuit 20 calculates the number of symbol errors of the drive signal according to the number of symbol errors. An execution subject of detecting the symbol error rate is not limited in the embodiment of the present disclosure.

Figure 4:
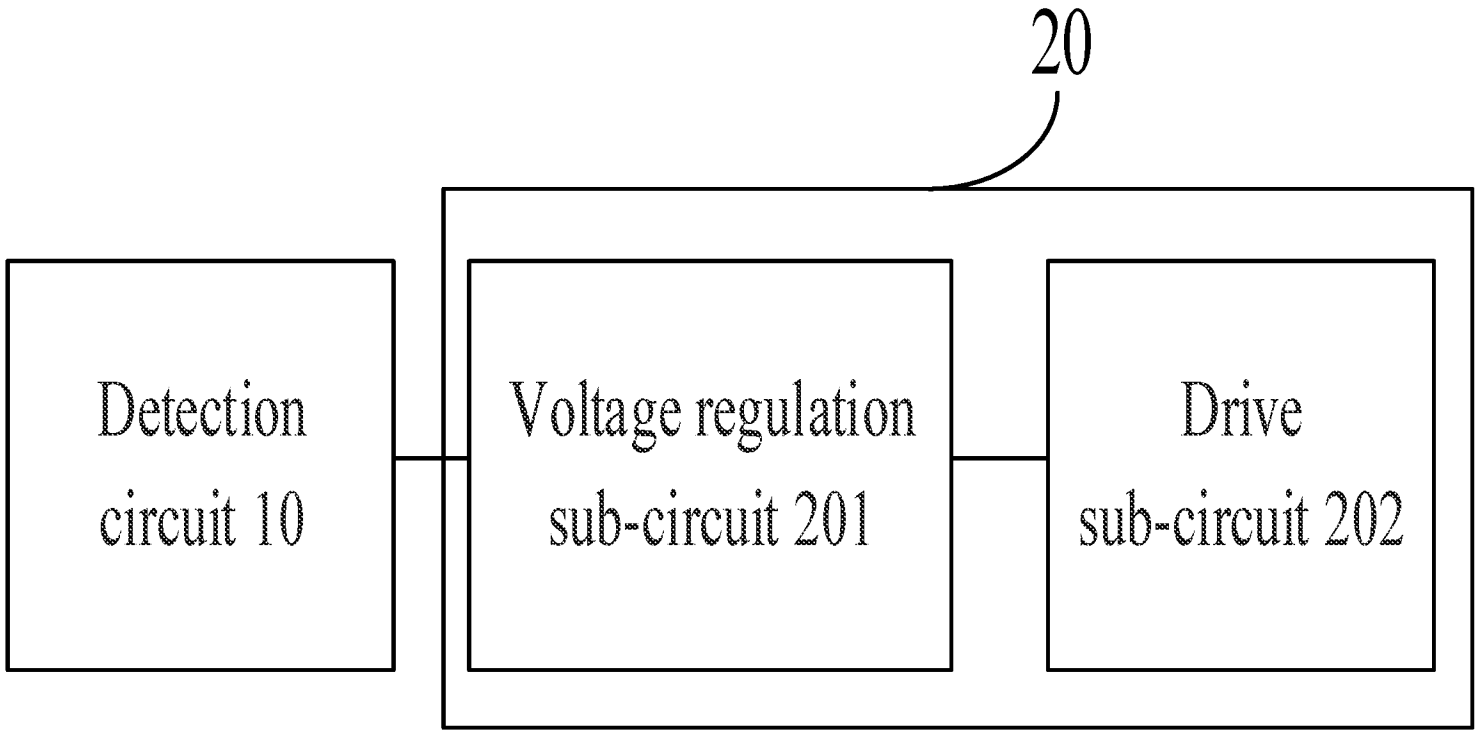
FIG. 4 is a schematic structural diagram of yet still another timing controller according to an embodiment of the present disclosure.

FIG. 4 is a schematic diagram showing a structure of yet another timing controller according to an embodiment of the present disclosure. As illustrated in FIG. 4, a control circuit 20 may include a voltage regulation sub-circuit 201 and a drive sub-circuit 202.

The voltage regulation sub-circuit 201 may be connected to a detection circuit 10 and the drive sub-circuit 202 respectively. For example, the voltage regulation sub-circuit 201 may be connected to the counter sub-circuit 102 in the detection circuit 10. The voltage regulation sub-circuit 201 may adjust an operating voltage applied to the drive sub-circuit 202 according to a symbol error rate. Moreover, a magnitude of the operating voltage is negatively correlated with a magnitude of the symbol error rate. That is, the larger the symbol error rate, the smaller the operating voltage; and the smaller the symbol error rate, the larger the operating voltage.

In the embodiment of the present disclosure, the voltage regulation sub-circuit 201 may directly adjust the operating voltage applied to the drive sub-circuit 202 according to the symbol error rate and a negative correlation relationship between the magnitude of the operating voltage and the magnitude of the symbol error rate. Alternatively, the voltage regulation sub-circuit 201 may further pre-store a corresponding relationship between the symbol error rate and the operating voltage. After the voltage regulation sub-circuit 201 obtains the symbol error rate, the operating voltage may be directly determined from the corresponding relationship, and the operating voltage applied to the drive sub-circuit 202 is directly regulated according to the determined operating voltage, such that the efficiency and the reliability in regulating the operating voltage are improved.

The drive sub-circuit 202 may be connected to the source drive circuit, and the drive sub-circuit 202 may adjust a voltage swing of the output drive signal according to the received operating voltage. Moreover, a magnitude of the adjusted voltage swing of the drive signal is positively correlated with the magnitude of the operating voltage. That is, the larger the operating voltage, the larger the adjusted voltage swing of the drive signal; and the smaller the operating voltage, the smaller the adjusted voltage swing of the drive signal.

In the embodiment of the present disclosure, after the operating voltage of the drive sub-circuit 202 changes, that is, after the voltage regulation sub-circuit 201 regulates the operating voltage applied to the drive sub-circuit 202 according to the symbol error rate, the drive sub-circuit 202 may realize an adjustment to the voltage swing of the drive signal, and the magnitude of the voltage swing of the adjusted drive signal is positively correlated with the magnitude of the operating voltage.

Figure 5:
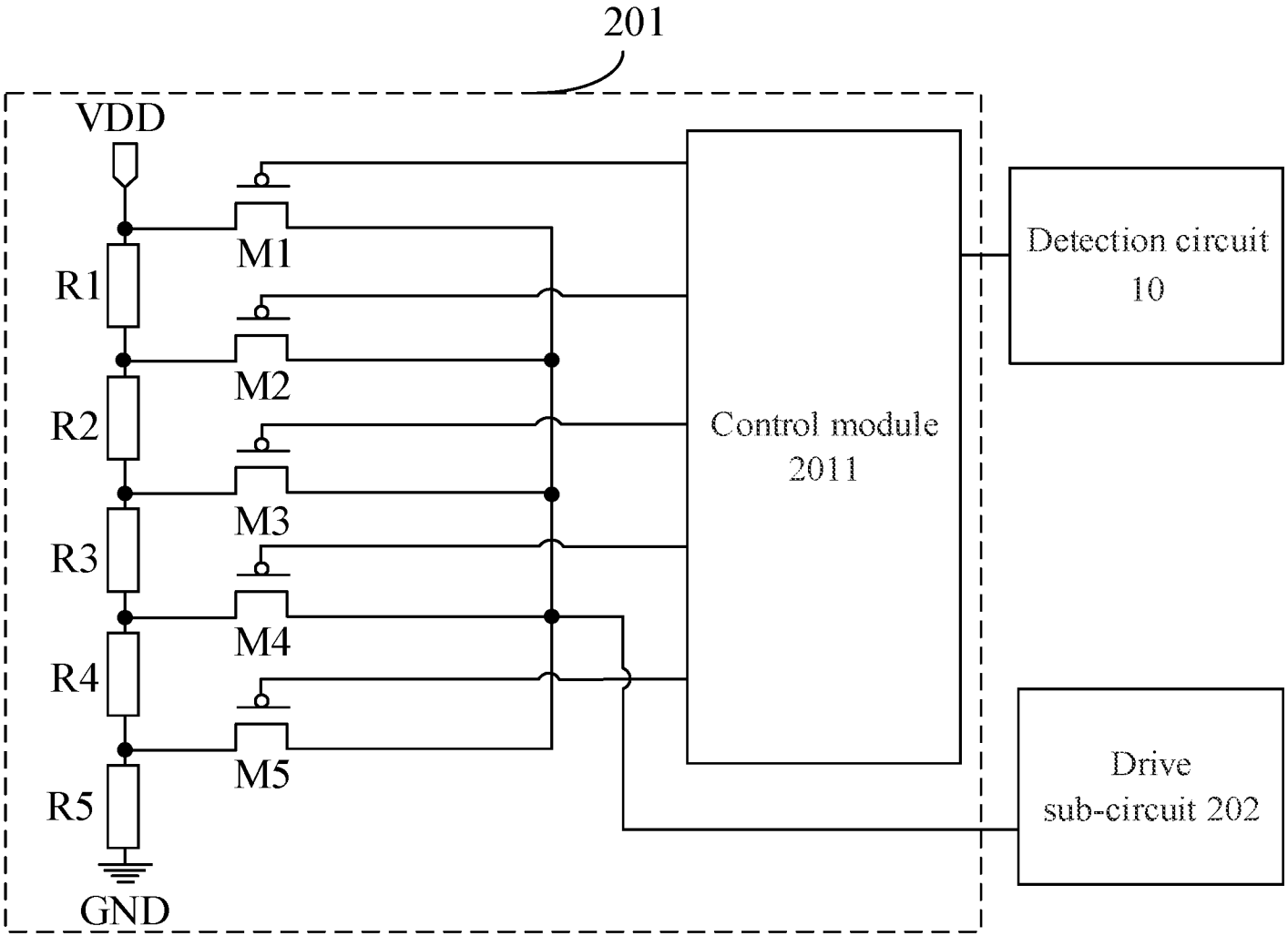
FIG. 5 is a schematic structural diagram of yet still another timing controller according to an embodiment of the present disclosure.

FIG. 5 is a schematic diagram showing a structure of still another timing controller according to an embodiment of the present disclosure. In an optional implementation, as illustrated in FIG. 5, the voltage regulation sub-circuit 201 in the timing controller may include a control module 2011, a plurality of resistors connected in series, and a plurality of switching resistors with the plurality of resistors connected in series.

The control module 2011 may be connected to a detection circuit 10 and a gate of each of the switching transistors respectively, and the control module 2011 may control an operating state of each switching transistor according to the symbol error rate. That is, the control module 2011 may control each switching transistor to be turned on or off according to the symbol error rate.

One terminals of the plurality of resistors connected in series may be connected to a first power supply terminal VDD, and the other terminals of the plurality of resistors R connected in series may be connected to a second power supply terminal. Optionally, the second power supply terminal may be a ground terminal GND.

A first pole of each switching transistor may be connected to one terminal of a corresponding one of the resistors, and a second pole of each switching transistor may be connected to the drive sub-circuit 202, for example, the second pole of each switching transistor may be connected to a power supply terminal of the drive sub-circuit 202. The voltage regulation sub-circuit 201 may be configured to adjust the voltage provided by the power supply terminal and then load the adjusted voltage into the drive sub-circuit 202.

Figure 6:
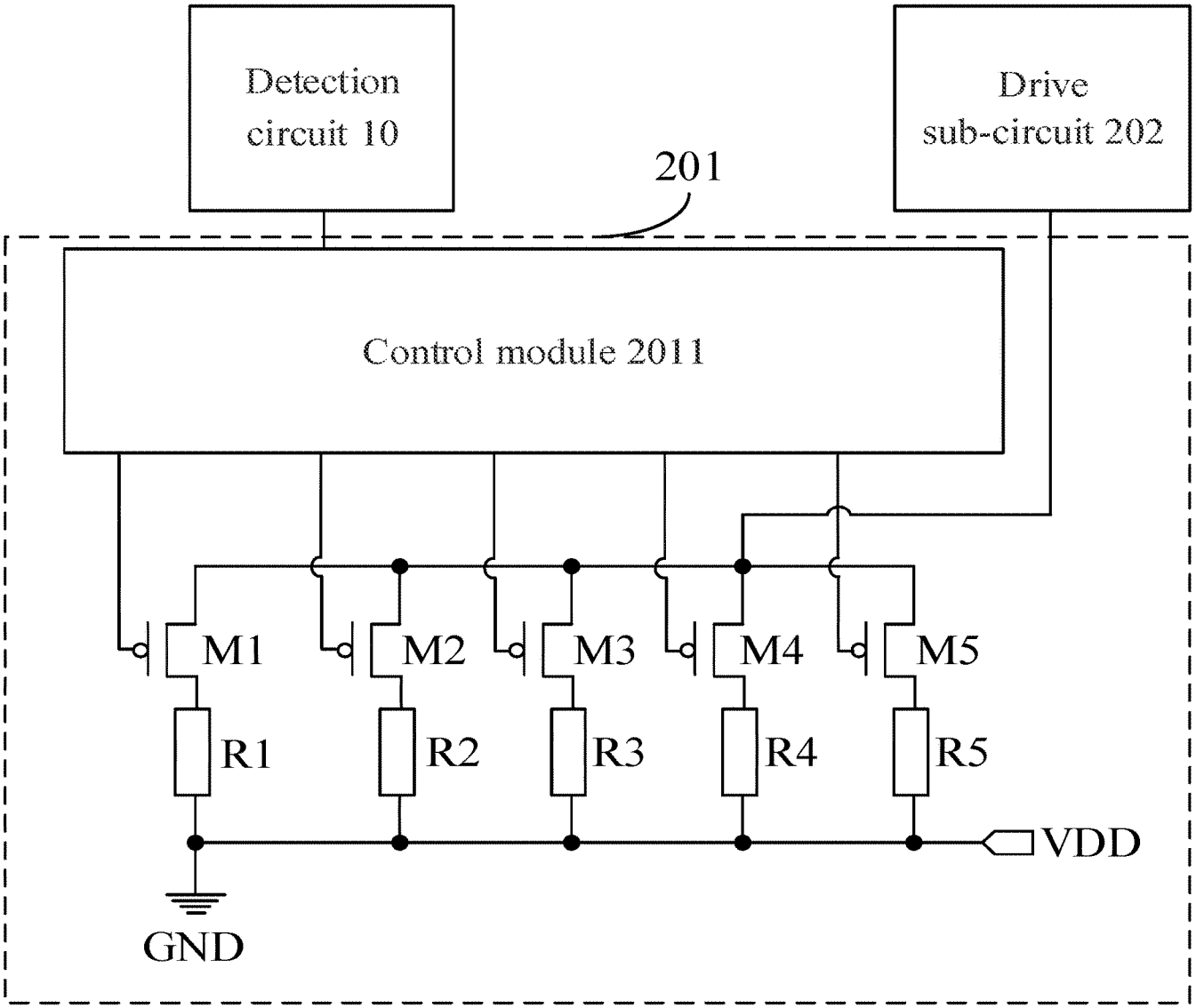
FIG. 6 is a schematic structural diagram of yet still another timing controller according to an embodiment of the present disclosure.

In another optional implementation, FIG. 6 is a schematic diagram showing a structure of yet still another timing controller according to an embodiment of the present disclosure. As illustrated in FIG. 6, the voltage regulation sub-circuit 201 may include a control module 2011, a plurality of resistors connected in parallel, and a plurality of switching transistors one-to-one corresponding to the plurality of resistors connected in parallel.

The control module 2011 may be connected to a detection circuit 10 and a gate of each switching transistor respectively, and the control module 2011 may control an operating state of each switching transistor according to the symbol error rate. That is, the control module 2011 may control each switching transistor to be turned on or off according to the symbol error rate.

One terminal of each of the plurality of resistors connected in parallel may be connected between a first power supply terminal VDD and a second power supply terminal, and the first power supply terminal VDD is connected to the second power supply terminal. Optionally, the second power supply terminal may be a ground terminal GND.

A first pole of each switching transistor may be connected to the other terminal of a corresponding one of the resistors, and a second pole of each switching transistor may be connected to the drive sub-circuit 202, for example, a second pole of each switching transistor may be connected to a power supply terminal of the drive sub-circuit 202. The voltage regulation sub-circuit 201 may be configured to adjust the voltage provided by the power supply terminal and then load the adjusted voltage into the drive sub-circuit 202.

In the embodiment of the present disclosure, the control module 2011 may be a register. The control module 2011 may output different control signals to the gate of each switching transistor according to the symbol error rate to control each switching transistor to be turned on or off. When different switching transistors are turned on, a conduction manner between the plurality of resistors connected in series or the plurality of resistors in parallel and the drive sub-circuit 202 may change. Accordingly, when the voltage regulation sub-circuit 201 applies the operating voltage to the drive sub-circuit 202, resistance values used are different, such that the operating voltage applied to the drive sub-circuit 202 is adjusted.

Optionally, in the embodiment of the present disclosure, the timing controller may divide the extent of the EMI on the display device into multiple levels in advance according to the symbol error rate, and generally, an interference level may be represented by an eye pattern level generated by using an oscilloscope according to the distortion of a display panel. Moreover, the timing controller may pre-store the voltage swings of the drive signals corresponding to different interference levels, and a corresponding relationship between the resistance values to be used.

After the voltage regulation sub-circuit 201 determines the interference level according to the symbol error rate, the resistance value to be used may be directly determined from the corresponding relationship. The control module 2011 in the voltage regulation sub-circuit 201 may control the on-off states of the plurality of switching transistors according to the determined resistance value, such that the operating voltage applied to the drive sub-circuit 202 may be adjusted by using the determined resistance value. After that, the drive sub-circuit 202 may adjust the voltage swing of the drive signal to a voltage swing corresponding to the resistance value according to the adjusted operating voltage, thereby improving the efficiency and the reliability when the voltage swing of the drive signal is adjusted.

By way of an example, Table 1 shows a corresponding relationship between interference levels, voltage swings, and resistance values pre-stored in the timing controller. As can be seen from Table 1, the timing controller divides the extent of interference on the display device into five levels (L1 to L5). The resistance value corresponding to the interference level L1 is r1, and the voltage swing is: [Vmin, Vmin+⅕ (Vmax−Vmin)].

TABLE 1

| Interference Level | Resistance Value | Voltage Swing of Drive Signal Vmin | - | Vmax |
|---|---|---|---|---|
| L1 | r1 | Vmin | - | Vmin + 1/5 (Vmax − Vmin) |
| L2 | r2 | Vmin + 1/5 (Vmax − Vmin) | - | Vmin + 2/5 (Vmax − Vmin) |
| L3 | r3 | Vmin + 2/5 (Vmax − Vmin) | - | Vmin + 3/5 (Vmax − Vmin) |
| L4 | r4 | Vmin + 3/5 (Vmax − Vmin) | - | Vmin + 4/5 (Vmax − Vmin) |
| L5 | r5 | Vmin + 4/5 (Vmax − Vmin) | - | Vmax |

When the voltage regulation sub-circuit 201 determines that the interference level of the display device interfered is L2 according to the symbol error rate, it is possible to determine from the corresponding relationship that the resistor with the resistance value r2 is required. At this time, the control module 2011 in the voltage regulation sub-circuit 201 may control whether each of the plurality of switching transistors is turned on or off, such that the resistance value used when the operating voltage applied to the drive sub-circuit 202 is adjusted is r2, and further the adjusted voltage swing of the drive signal may be [Vmin+⅕(Vmax−Vmin), Vmin+⅖(Vmax−Vmin)].

Optionally, as illustrated in FIG. 5 and FIG. 6, the voltage regulation sub-circuit 201 may include five resistors R1 to R5, and five switching transistors M1 to M5 one-to-one corresponding to the five resistors.

By using the five resistors and the five switching transistors, it is possible to avoid the problem of unobvious improvement effect due to overlarge adjustment amplitude when fewer resistors are used, and further to avoid the problem of unobvious improvement effect due to small adjustment magnitude when more resistors are used. That is, the EMI may be effectively reduced.

Optionally, in the embodiment of the present disclosure, the detection circuit 10 may further send a symbol error rate to the source drive circuit, and the source drive circuit may send a hold signal to the control circuit 20 according to the symbol error rate.

The control circuit 20 may adjust the voltage swing of the drive signal according to the symbol error rate detected by the detection circuit 10 when the potential of the hold signal is an effective potential, and inhibit an adjustment to the voltage swing of the drive signal when the potential of the hold signal is an ineffective potential.

When the symbol error rate is relatively small, the overall display effect of the display device may be affected. Therefore, in order to ensure the reliability of reducing the EMI and reduce the power consumption of the control circuit 20, the source drive circuit may transmit the hold signal to the control circuit 20 according to the symbol error rate, such that the control circuit 20 may determine whether it is necessary to adjust the voltage swing of the drive signal according to the potential of the received hold signal.

Optionally, the source drive circuit may store a symbol error rate threshold. When the source drive circuit detects that the symbol error rate is greater than the symbol error rate threshold, the control circuit 20 may send a hold signal whose potential is an effective potential to the control circuit 20. At this time, the control circuit will adjust the voltage swing of the drive signal according to the symbol error rate. Alternatively, the symbol error rate threshold may be stored in the control circuit 20. The control circuit 20 may directly detect whether the symbol error rate is greater than the symbol error rate threshold, and determine whether it is necessary to adjust the voltage swing of the drive signal according to a detection result. Under a premise of ensuring the reliability of reducing the EMI, the efficiency of reducing the EMI is improved.

Optionally, in the embodiment of the disclosure, the timing controller may be a timer control register (TCON) chip, and the detection circuit 10 and the control circuit 20 may be integrated in the TCON chip, accordingly, an additional space of the display device may be prevented from being occupied, and a pin of the TCON chip may be prevented from being occupied. Alternatively, the timing controller may include a TCON chip, and a detection circuit 10 and a control circuit 20 that are disposed independently of the ICON chip. Alternatively, the timing controller may include a TCON chip, and a detection circuit 10 disposed independently of the ICON chip, wherein the control circuit 20 of the timing controller may be integrated in the TCON chip. Alternatively, the driver sub-circuit 202 in the control circuit 20 may be integrated in a TCON chip, and the voltage regulation sub-circuit 201 in the control circuit 20 may be disposed independently of the TCON chip. An implementation of each circuit in the timing controller is not limited in the embodiment of the present disclosure.

In summary, the present disclosure provides a timing controller. The timing controller may include a detection circuit and a control circuit. The detection circuit may detect a symbol error rate of a drive signal transmitted to a source drive circuit by the control circuit, and send the symbol error rate to the control circuit. The control circuit may automatically adjust the voltage swing of the drive signal according to the symbol error rate of the drive signal, and may enable a magnitude of the adjusted voltage swing to negatively correlate with a magnitude of the symbol error rate. Therefore, the electromagnetic interference is effectively reduced, and the flexibility in reducing the electromagnetic interference is improved.

Figure 7:
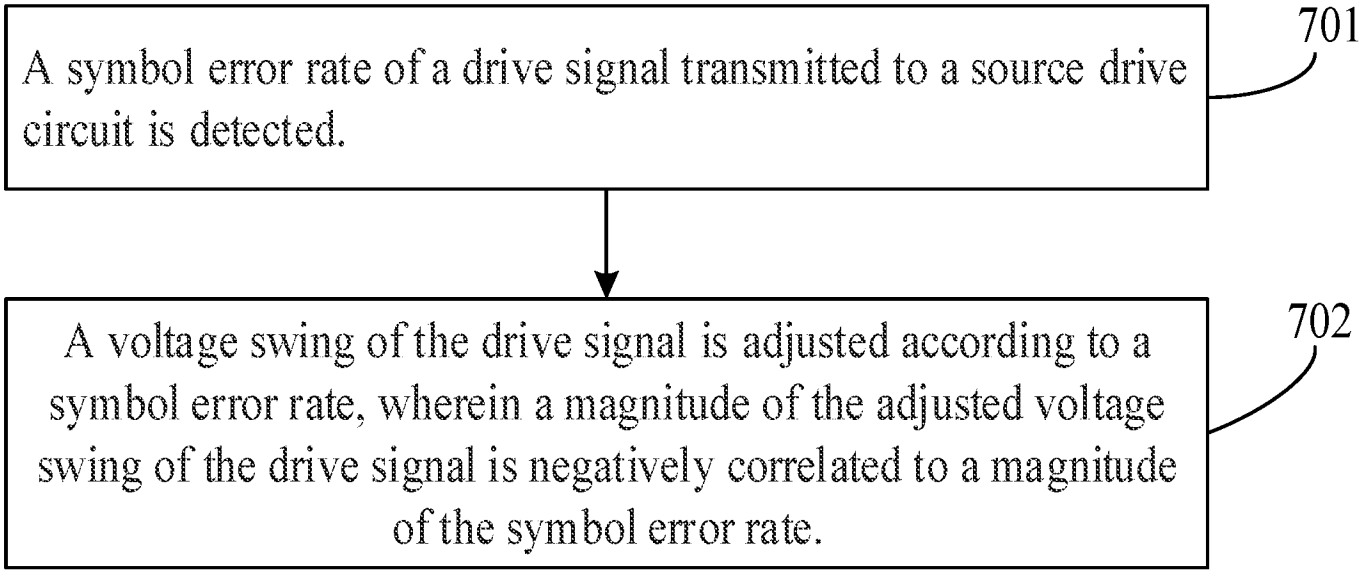
FIG. 7 is a flowchart of a driving method of a timing controller according to an embodiment of the present disclosure.

FIG. 7 is a flow diagram of a driving method of a timing controller according to an embodiment of the present disclosure. The method may be applied to the timing controller as illustrated in any of FIG. 1 to FIG. 6. As illustrated in FIG. 7, the method may include the following steps.

In step 701, a symbol error rate of a drive signal transmitted to a source drive circuit is detected.

In the embodiment of the present disclosure, with reference to FIG. 1, the timing controller may include a detection circuit 10 and a control circuit 20. A symbol error rate of a drive signal may refer to a ratio of the number of symbols which are erroneous in a drive signal received by the source drive circuit within a preset time period to the total number of symbols of a drive signal transmitted to the source drive circuit by the control circuit 20. The preset time period may be a time period preset by the timing controller or a time period preset by a user. The embodiment of the present disclosure sets no limitation thereto.

In the embodiment of the present disclosure, the detection circuit 10 may detect whether the drive signal transmitted to the source drive circuit by the control circuit 20 is the same as the drive signal received by the source drive circuit within a preset time period. When the detection circuit 10 detects that the drive signal received by the source drive circuit is different from the drive signal transmitted by the control circuit 20, it may be determined that the drive signal has a symbol error. Further, the detection circuit 10 may calculate the symbol error rate of the drive signal according to the detected number of symbol errors and the total number of symbols of the drive signal transmitted by the control circuit 20. Alternatively, the detection circuit 10 may send the determined number of symbol errors to the control circuit 20, and the control circuit 20 calculates the symbol error rate according to the number of symbol errors. The embodiment of the present disclosure sets no limitation thereto.

In step 702, a voltage swing of the drive signal is adjusted according to a symbol error rate, wherein a magnitude of the adjusted voltage swing of the drive signal is negatively correlated to a magnitude of the symbol error rate.

Negative correlation between the magnitude of the adjusted voltage swing of the drive signal and the magnitude of the symbol error rate means that: the larger the symbol error rate, the smaller the adjusted voltage swing of the drive signal; and the smaller the symbol error rate, the larger the adjusted voltage swing of the drive signal.

In the embodiment of the present disclosure, the detection circuit 20 may automatically adjust the voltage swing of the drive signal according to the symbol error rate. Moreover, when the received symbol error rate is relatively large, the control circuit 20 may correspondingly reduce the voltage swing of the drive signal. The larger the symbol error rate, the less gradual the peak value of the drive signal, and therefore, the weaker the anti-EMI capability. At this time, the peak value of the drive signal may be made more gradual by reducing the voltage swing of the drive signal, such that its anti-EMI capability is improved. When the symbol error rate is relatively small, the control circuit 20 may correspondingly increase the voltage swing of the drive signal. The smaller the symbol error rate, the more gradual the peak value of the drive signal, and therefore, noise interference may be caused. At this time, by increasing the voltage swing of the drive signal, the peak value of the drive signal may be made less gradual, and thus the noise interference may be avoided, and the anti-noise interference capability is improved.

In summary, the present disclosure provides a driving method of a timing controller. The timing controller may detect a symbol error rate of a drive signal transmitted to the source drive circuit by the timing controller, may automatically adjust a voltage swing of the drive signal according to the detected symbol error rate, and may enable a magnitude of the adjusted voltage swing to negatively correlate with a magnitude of the symbol error rate. Therefore, the electromagnetic interference is effectively reduced, and the flexibility in reducing the electromagnetic interference is improved.

Figure 8:
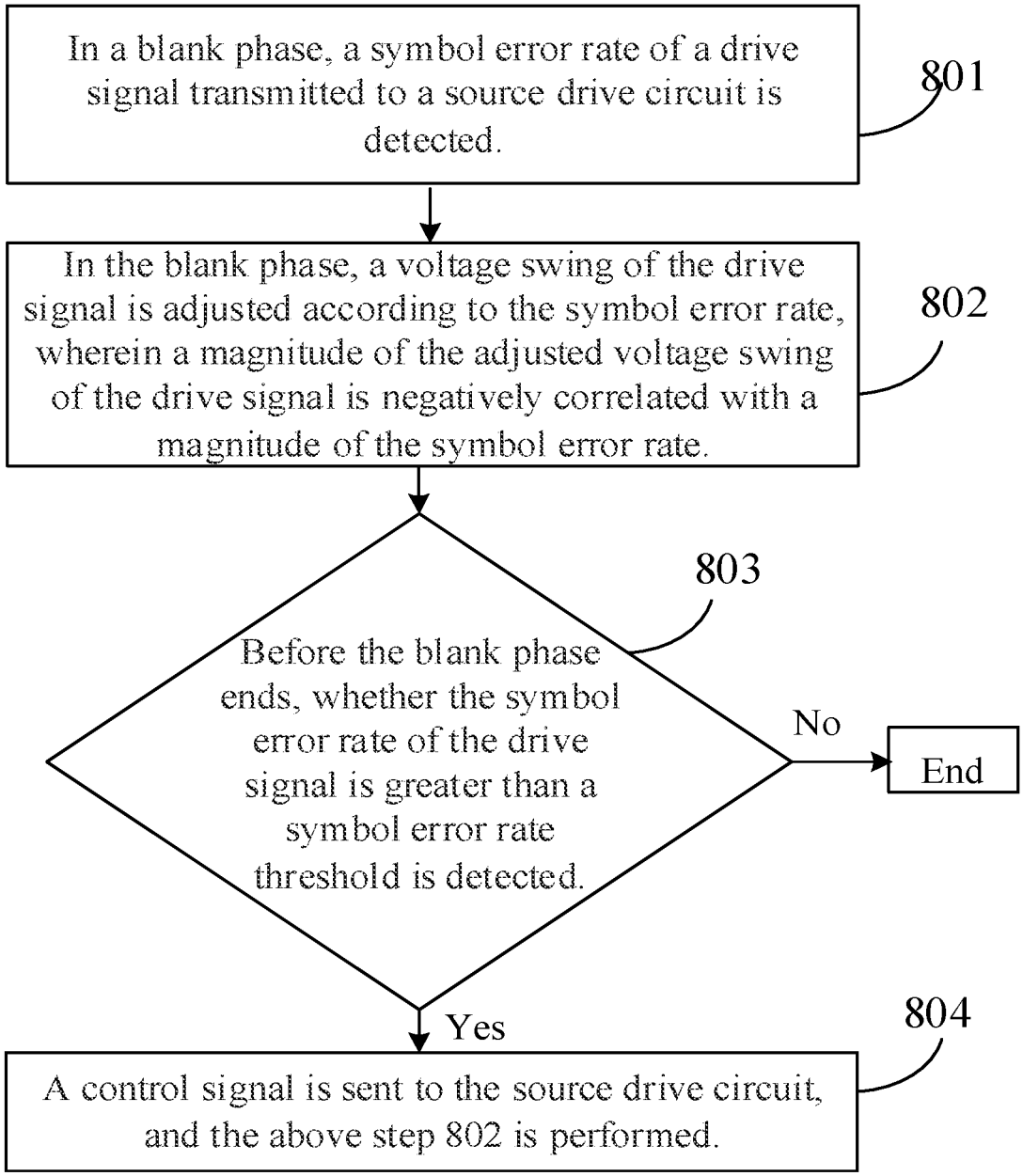
FIG. 8 is a flowchart of another driving method a timing controller according to an embodiment of the present disclosure.

FIG. 8 is a flow diagram of a driving method of another timing controller according to an embodiment of the present disclosure. The driving method may be applied to a timing controller as illustrated any one of FIG. 1 to FIG. 6. As illustrated in FIG. 8, the method may include the following steps.

In step 801, in a blank phase, a symbol error rate of a drive signal transmitted to a source drive circuit is detected.

In the embodiment of the present disclosure, with reference to FIG. 1, the timing controller may include a detection circuit 10 and a control circuit 20. A symbol error rate of the drive signal may refer to a ratio of the number of symbols which are erroneous in the drive signal received by the source drive circuit within a preset time period to the total number of symbols of the drive signal transmitted to the source drive circuit by the control circuit 20. The preset time period may be a time period preset by the timing controller or a time period preset by a user. The embodiment of the present disclosure sets no limitation thereto.

The detection circuit 10 may detect whether the drive signal transmitted to the source drive circuit by the control circuit 20 is the same as the drive signal received by the source drive circuit. For example, the detection circuit 10 may detect whether at least one parameter of parameters such as magnitudes, frequencies, or phases of the drive signal transmitted by the control circuit 20 and a drive signal received by the source drive circuit is the same. When the detection circuit 10 detects that any one parameter of the drive signal received by the source drive circuit and the drive signals transmitted by the control circuit 20 is different, it may be determined that the drive signal has a symbol error. Further, the detection circuit 10 may calculate the symbol error rate of the drive signal according to the detected number of symbol errors and the total number of symbols of the drive signal transmitted by the control circuit 20. Alternatively, the detection circuit 10 may send the determined number of symbol errors to the control circuit 20, and the control circuit calculates the symbol error rate according to the number of symbol errors and the total number of symbols transmitted by the control circuit. An execution subject of detecting the symbol error rate of the drive signal is not limited in the embodiment of the present disclosure.

Optionally, with reference to FIG. 2, the detection circuit 10 according to the embodiment of the present disclosure may include an operation sub-circuit 101 and a counter sub-circuit 102, wherein the operation sub-circuit 101 may perform a logic operation on a drive signal outputted from the timing controller and a drive signal received from a source drive circuit 01, and the counter sub-circuit 102 may determine a symbol error rate of the drive signal according to an operation result.

As illustrated in FIG. 3, the operation sub-circuit 101 may be an exclusive OR logic sub-circuit, and the counter sub-circuit 102 may be a T-trigger counter. As can be seen from an operation logic of the exclusive OR logic sub-circuit, when a signal received by a first input terminal A of the operation sub-circuit 101 is 0, a signal received by a second input terminal B is 1, that is, when the signal received by the first input terminal A and the signal received by the second input terminal B are different, the operation result outputted from an output terminal C to the counter sub-circuit 102 is 1. When the signal received by the first input terminal A of the operation sub-circuit 101 is 1, the signal received by the second input terminal B is 1, that is, the signal received by the first input terminal A of the operation sub-circuit 101 and the signal received by the second input terminal B are the same, the operation result outputted from the output terminal C to the counter sub-circuit 102 is 0.

In the embodiment of the present disclosure, the first input terminal A of the operation sub-circuit 101 is connected to the output terminal OUT of the control circuit 20, and the second input terminal B is connected to the input terminal IN0 of the source drive circuit 01. Therefore, when the drive signal transmitted from the control circuit 20 to the source drive circuit 01 is different from the drive signal received by the source drive circuit 01 (that is, when the drive signal has a symbol error), the operation sub-circuit 101 may output 1 to the counter sub-circuit 102. When the drive signal transmitted from the control circuit 20 to the source drive circuit 01 is the same as the drive signal received by the source drive circuit 01 (that is, when the drive signal has no symbol error), the operation sub-circuit 101 may output 0 to the counter sub-circuit 102.

Further, the counter sub-circuit 102 may accumulate the received operation result to obtain the number of symbol errors, Moreover, the counter sub-circuit 102 may directly calculate the symbol error rate according to the number of symbol errors, and send the symbol error rate to the control circuit 20. Alternatively, the counter sub-circuit 102 may send the calculated symbol error rate to the control circuit 20, and the control circuit 20 calculates the symbol error rate of the drive signal according to the received number of symbol errors. The embodiment of the present disclosure sets no limitation thereto.

In order to avoid the impacts on normal display of a display panel when the EMI is reduced, the detection circuit 10 or the control circuit 20 may detect the symbol error rate of the drive signal transmitted to the source drive circuit in a blank phase, and the blank phase may be a vertical blank (V-Blank) phase when two adjacent frame images are displayed in a switching manner. In this blank phase, the source drive circuit may be in a hold state, that is, the source drive circuit may control the display panel to keep displaying the previous frame image.

In step 802, in the blank phase, a voltage swing of the drive signal is adjusted according to the symbol error rate, wherein a magnitude of the adjusted voltage swing of the drive signal is negatively correlated with a magnitude of the symbol error rate.

Negative correlation between the magnitude of the adjusted voltage swing of the drive signal and the magnitude of the symbol error rate means that: the larger the symbol error rate, the smaller the adjusted voltage swing of the drive signal; and the smaller the symbol error rate, the larger the adjusted voltage swing of the drive signal.

In the embodiment of the present disclosure, with reference to FIG. 4, the control circuit 20 may include a voltage regulation sub-circuit 201 and a drive sub-circuit 202. The voltage regulation sub-circuit 201 may adjust an operating voltage applied to the drive sub-circuit 202 according to the symbol error rate, wherein a magnitude of the operating voltage is negatively correlated with a magnitude of the symbol error rate, that is, the larger the symbol error rate, the smaller the operating voltage; and the smaller the symbol error rate, the larger the operating voltage. The drive sub-circuit 202 may adjust the voltage swing of the drive signal according to the adjusted operating voltage, wherein a magnitude of the adjusted voltage swing of the drive signal is positively correlated with a magnitude of the operating voltage. That is, the larger the operating voltage, the larger the adjusted voltage swing of the drive signal is; and the smaller the operating voltage, the smaller the adjusted voltage swing of the drive signal.

Further, with reference to FIG. 5, the voltage regulation sub-circuit 201 may include a control module 2011, a plurality of resistors connected in series, and a plurality of switching resistors one-to-one corresponding to the plurality of resistors connected in series. In the embodiment of the present disclosure, the control module 2011 may control an operating state of each switching transistor according to the symbol error rate, that is, controlling each switching transistor to be turned on or off. When different switching transistors are turned on, a conduction manner between the plurality of resistors connected in series or the plurality of resistors connected in parallel and the drive sub-circuit 202 may change. Accordingly, when the voltage regulation sub-circuit 201 applies an operating voltage to the drive sub-circuit 202, resistance values used may be different, such that the operating voltage applied to the drive sub-circuit 202 is adjusted. The drive sub-circuit 202 may adjust the voltage swing of the drive signal according to the received operating voltage.

Optionally, with reference to the above Table 1, the timing controller may divide the extent of the EMI on the display device into multiple levels in advance according to the symbol error rate, and may pre-store a corresponding relationship between interference levels, voltage swings and resistance values. When the voltage regulation sub-circuit 201 determines the interference level according to the symbol error rate, the resistance value to be used may be directly determined from the corresponding relationship. The control module 2011 in the voltage regulation sub-circuit 201 may control the on-off states of the plurality of switching transistors according to the determined resistance value, such that the operating voltage applied to the drive sub-circuit 202 may be adjusted by using the determined resistance value. Afterwards, the drive sub-circuit 202 may adjust the voltage swing of the drive signal to a voltage swing corresponding to the resistance value according to the adjusted operating voltage, thereby improving the efficiency and the reliability when the voltage swing of the drive signal is adjusted.

In the embodiment of the present disclosure, when the symbol error rate is relatively small, it is impossible to influence the whole display effect of the display device, and demands of different display devices for the display effect may be different. Accordingly, in order to ensure the reliability of reducing the EMI and reduce the power consumption of the control circuit 20, the embodiment of the present disclosure may perform the above step 802 when there are the following two cases.

As an optional implementation, the timing controller may detect whether the symbol error rate of the drive signal is greater than a symbol error rate threshold. When the timing controller detects that the symbol error rate is greater than the symbol error rate threshold, the voltage swing of the drive signal may be adjusted according to the symbol error rate.

The symbol error rate threshold may be a symbol error rate threshold preset in the timing controller. When the timing controller detects that the symbol error rate is greater than the symbol error rate threshold, it may be determined that it is necessary to adjust the voltage swing of the drive signal at this time. At this time, the control circuit 20 in the timing controller may adjust the voltage swing of the drive signal according to the detected symbol error rate. When the timing controller detects that the symbol error rate is not greater than the symbol error rate threshold, it may be determined that it is unnecessary to adjust the voltage swing of the drive signal, that is, the control circuit 20 may inhibit an adjustment to the voltage swing of the drive signal.

As another optional implementation, before the voltage swing of the drive signal is adjusted according to the symbol error rate, that is, before the step 802 is performed, the timing controller may receive a hold signal transmitted by the source drive circuit. When a potential of the hold signal received by the timing controller is an effective potential, the above step 802 may be performed, that is, the voltage swing of the drive signal is adjusted according to the symbol error rate; and accordingly, when the potential of the received hold signal is an ineffective potential, it is possible to inhibit an adjustment to the voltage swing of the drive signal.

In the embodiment of the present disclosure, the detection circuit 10 may further send the detected symbol error rate to the source drive circuit, and the source drive circuit determines whether it is necessary to adjust the voltage swing of the drive signal according to the symbol error rate. The symbol error rate threshold may further be pre-stored in the source drive circuit. When the source drive circuit detects that the symbol error rate is greater than the symbol error rate threshold, it may be determined that it is necessary to adjust the voltage swing at this time. Correspondingly, the source drive circuit may send a hold signal whose potential is an effective potential to the control circuit 20, and the control circuit 20 may adjust the voltage swing according to the symbol error rate. When the source drive circuit detects that the symbol error rate is not greater than the symbol error rate threshold, it may be determined that it is unnecessary to adjust the voltage swing at this time. Accordingly, the source drive circuit may send a hold signal whose potential is an ineffective potential to the control circuit 20, such that the control circuit 20 may inhibit an adjustment to the voltage swing at this time.

In the embodiment of the present disclosure, the foregoing step 802 may further be performed in the V-Blank phase, that is, the control circuit 20 in the timing controller may adjust the voltage swing of the drive signal according to the symbol error rate in the V-Blank phase. By adjusting the voltage swing of the drive signal in the V-Blank phase, the EMI may be reduced without influencing the normal display of the display panel.

In step 803, before the blank phase ends, whether the symbol error rate of the drive signal is greater than a symbol error rate threshold is detected.

In order to further reduce the influence of the EMI on the display effect of the display panel, the timing controller may further detect whether the symbol error rate of the drive signal is greater than the symbol error rate threshold before the blank phase ends.

When the timing controller detects that the symbol error rate of the drive signal is still greater than the symbol error rate threshold, it is possible to continuously perform the following step 804. When the timing controller detects that the symbol error rate of the drive signal is not greater than the symbol error rate threshold, it is possible to control the normal operation of the display device, that is, to end the adjustment to the voltage swing of the drive signal.

In step 804, a control signal is sent to the source drive circuit, and the above step 802 is performed.

In the embodiment of the present disclosure, the control signal may be intended to indicate that the source drive circuit is in a hold state in a display phase after the blank phase. When the timing controller detects the symbol error rate is greater than the symbol error rate threshold before the blank phase, the control signal may be sent to the source drive circuit, such that the source drive circuit continues to display the previous frame image. Moreover, at this time, the control circuit 20 in the timing controller may perform the above step 802 again, that is, the voltage swing of the drive signal is continuously adjusted according to the symbol error rate within the holding state, thereby further reducing the influence of the EMI on the display effect of the next frame image, and ensuring the reliability of reducing the EMI.

Moreover, in order to prevent the problem that the image displayed by the display panel is stuck since the display panel displays the same frame image for a long time, the timing controller may control the source drive circuit to be in the hold state only for one frame time. When the hold state of one frame ends, the timing controller may directly control the source drive circuit to continuously drive the display panel to display the next frame image.

The sequence of the steps of the driving method of the timing controller according to the embodiment of the present disclosure may be appropriately adjusted, and the steps may further be correspondingly increased or decreased as required. For example, the above steps 803 and 804 may be deleted, that is, when it is detected that the symbol error rate is greater than the symbol error rate threshold before the blank phase ends, the display panel is directly controlled to display the next frame image. A method that may be readily conceived by those skilled in the art within the technical scope disclosed in the present disclosure is intended to be included in the protective scope of the present disclosure, and therefore will not be described again.

In summary, the present disclosure provides a driving method of a timing controller. The timing controller may detect a symbol error rate of a drive signal transmitted to a source drive circuit by control circuit, may automatically adjust a voltage swing of the drive signal according to the detected symbol error rate, and may enable a magnitude of the adjusted voltage swing to negatively correlate with a magnitude of the symbol error rate. Therefore, the electromagnetic interference is effectively reduced, and the flexibility in reducing the electromagnetic interference is improved.

Figure 9:
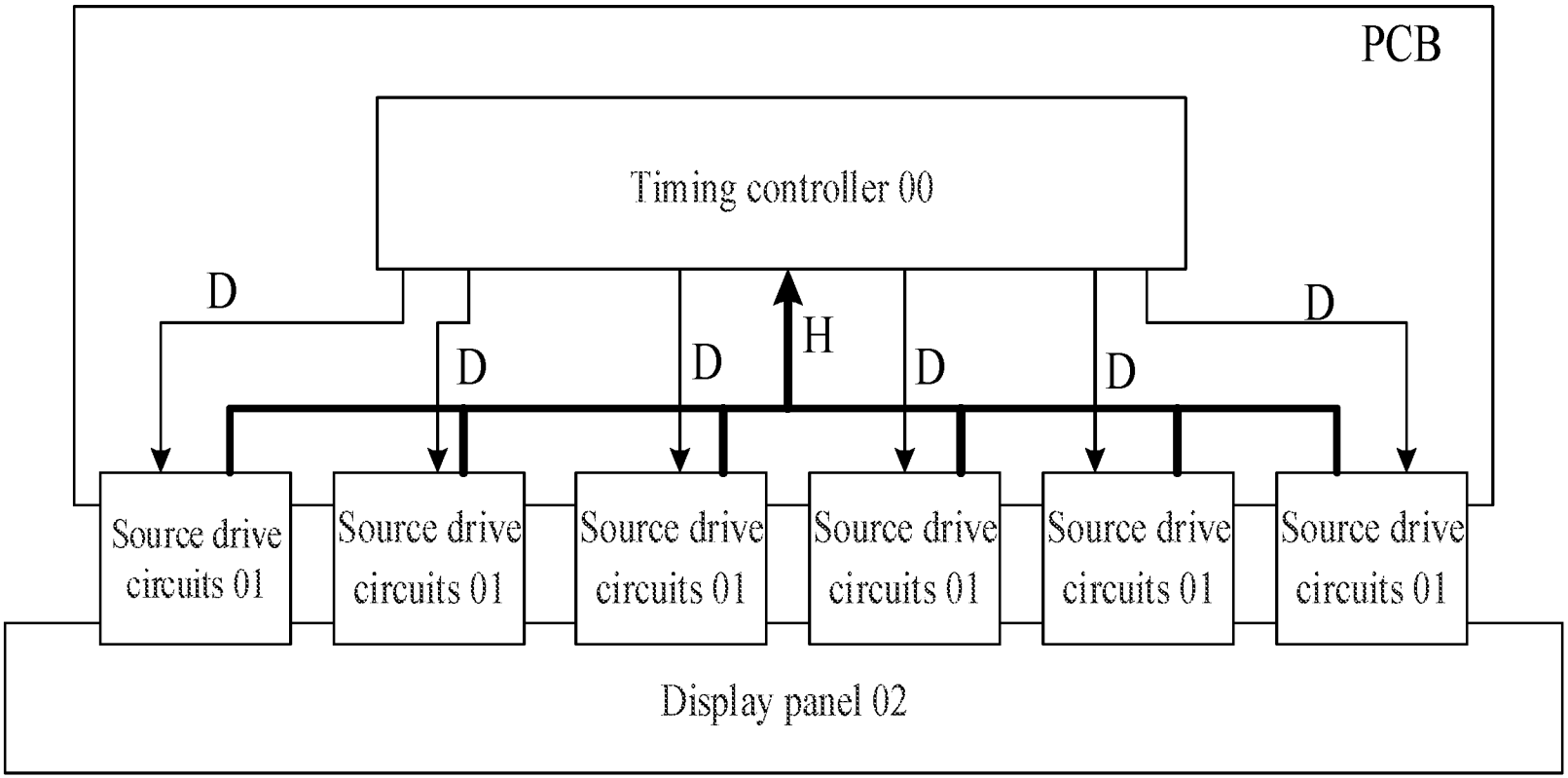
FIG. 9 is a schematic structural diagram of a display device according to an embodiment of the present disclosure.

FIG. 9 is a schematic diagram showing a structure of a display device according to an embodiment of the present disclosure. As illustrated in FIG. 9, the display device may include a timing controller 00 as illustrated in any of FIG. 1 to FIG. 6.

As can be seen with reference to FIG. 9, the timing controller 00 may be disposed on a printed circuit board (PCB). The display device may further include a plurality of source drive circuits 01 connected to the timing controller 00 (only six source drive circuits 01 are schematically illustrated in FIG. 9), and a display panel 02 connected to the source drive circuit 01. The timing controller 00 may transmit a drive signal (such as a data signal D) to each of the source drive circuits 01, and the source drive circuit 01 may control an operating state of the display panel 02 according to the drive signal transmitted to the source drive circuit 01 by the timing controller 00.

In the embodiment of the present disclosure, the timing controller 00 may adjust a voltage swing of the drive signal transmitted to the source drive circuit 01 according to the detected symbol error rate, thereby reducing the influence of the EMI on the display effect of the display panel 02. With reference to FIG. 9, it can be seen that the source drive circuit 01 may further send a hold signal H to the timing controller 00 according to the symbol error rate detected by the detection circuit 10 in the timing controller 00, and the timing controller 00 may determine whether it is necessary to adjust the voltage swing of the drive signal according to a potential of the received hold signal H, thereby improving the reliability of reducing the EMI.

It should be clearly understood by those skilled in the art that for convenience and simplicity of the description, an operating process of the timing controller described above may refer to a corresponding process in the foregoing method embodiments, and will not be described herein again.

Detailed above are only embodiments of the present disclosure, and are not intended to limit the present disclosure. Within the spirit and principles of the disclosure, any modifications, equivalent substitutions or improvements are within the protection scope of the present disclosure.

The invention claimed is:

1. A timing controller comprising a detection circuit and a control circuit, wherein the control circuit is connected to a source drive circuit, and the detection circuit is connected to the source drive circuit and the control circuit respectively;

the control circuit is configured to transmit a drive signal to the source drive circuit;

the detection circuit is configured to detect a symbol error rate of the drive signal;

the control circuit is further configured to adjust a voltage swing of the drive signal according to a symbol error rate detected by the detection circuit, wherein a magnitude of the voltage swing of the drive signal is negatively correlated with a magnitude of the symbol error rate, and the voltage swing of the drive signal refers to a maximum value and a minimum voltage of a voltage of the drive signal; and wherein the detection circuit is further configured to send the symbol error rate to the source drive circuit, and the source drive circuit is configured to send a hold signal to the control circuit according to the symbol error rate; and the control circuit is further configured to adjust a voltage swing of the drive signal according to a symbol error rate detected by the detection circuit when a potential of the hold signal is an effective potential, and inhibit an adjustment to the voltage swing of the drive signal when a potential of the hold signal is an ineffective potential.

2. The timing controller according to claim 1, wherein the detection circuit comprises an operation sub-circuit and a counter sub-circuit; wherein a first input terminal of the operation sub-circuit is connected to an output terminal of the control circuit, a second input terminal of the operation sub-circuit is connected to an input terminal of the source drive circuit, an output terminal of the operation sub-circuit is connected to the counter sub-circuit, and the counter sub-circuit is further connected to an input terminal of the control circuit;

the operation sub-circuit is configured to perform a logic operation on a drive signal outputted from the output terminal of the control circuit and a drive signal received from the input terminal of the source drive circuit, and send an operation result of the logic operation to the counter sub-circuit; and the counter sub-circuit is configured to determine a symbol error rate of the drive signal according to the operation result, and send the symbol error rate to the input terminal of the control circuit.

3. The timing controller according to claim 2, wherein the operation sub-circuit is an exclusive OR logic sub-circuit.

4. The timing controller according to claim 1, wherein the control circuit comprises a voltage regulation sub-circuit and a drive sub-circuit; wherein the voltage regulation sub-circuit is connected to the detection circuit and the drive sub-circuit respectively, and the drive sub-circuit is connected to the source drive circuit;

the voltage regulation sub-circuit is configured to regulate an operating voltage applied to the drive sub-circuit according to the symbol error rate, wherein a magnitude of the operating voltage is negatively correlated with a magnitude of the symbol error rate; and the drive sub-circuit is configured to adjust a voltage swing of the output drive signal according to the operating voltage, wherein a magnitude of the voltage swing of the drive signal is positively correlated with a magnitude of the operating voltage.

5. The timing controller according to claim 4, wherein the voltage regulation sub-circuit comprises a control module, a plurality of resistors connected in series, and a plurality of switching transistors one-to-one corresponding to the plurality of resistors connected in series; wherein the control module is connected to the detection circuit and a gate of each of the switching transistors respectively; one terminals of the plurality of resistors connected in series are connected to a first power supply terminal, and the other terminals of the plurality of resistors connected in series are connected to a second power supply terminal; a first pole of each of the switching transistors is connected to one terminal of a corresponding one of the resistors, and a second pole of each of the switching transistors is connected to the drive sub-circuit; and the control module is configured to control an operating state of each of the switching transistors according to the symbol error rate.

6. The timing controller according to claim 5, wherein the voltage regulation sub-circuit comprises five resistors and five switching transistors one-to-one corresponding to the five resistors.

7. The timing controller according to claim 4, wherein the voltage regulation sub-circuit comprises a control module, a plurality of resistors connected in parallel, and a plurality of switching transistors one-to-one corresponding to the plurality of resistors connected in parallel; wherein the control module is connected to the detection circuit and a gate of each of the switching transistors respectively; one terminal of each of the plurality of resistors connected in parallel is connected between the first power supply terminal and the second power supply terminal, the first power supply terminal is connected to the second power supply terminal; a first pole of each of the switching transistors is connected to the other terminal of a corresponding one of the resistors, and a second pole of each of the switching transistors is connected to the drive sub-circuit; and the control module is configured to control an operating state of each of the switching transistors according to the symbol error rate.

8. The timing controller according to claim 7, wherein the voltage regulation sub-circuit comprises five resistors and five switching transistors one-to-one corresponding to the five resistors.

9. A driving method of a timing controller, comprising:

detecting a symbol error rate of a drive signal transmitted to a source drive circuit;

adjusting a voltage swing of the drive signal according to the symbol error rate, wherein a magnitude of the voltage swing of the drive signal is negatively correlated with a magnitude of the symbol error rate, and the voltage swing of the drive signal refers to a maximum value and a minimum value of a voltage of the drive signal; and wherein before the adjusting the voltage swing of the drive signal according to the symbol error rate, the method further comprises:

receiving a hold signal sent by the source drive circuit;

the adjusting the voltage swing of the drive signal according to the symbol error rate comprises:

adjusting the voltage swing of the drive signal according to the symbol error rate when the received potential of the hold signal is an effective potential; and the method further comprises: inhibiting an adjustment to the voltage swing of the drive signal when the received potential of the hold signal is an ineffective potential.

10. The method according to claim 9, wherein the detecting a symbol error rate of a drive signal transmitted to a source drive circuit comprises:

performing a logic operation on a drive signal outputted by the timing controller and a drive signal received by the source drive circuit;

determining the symbol error rate of the drive signal according to an operation result.

11. The method according to claim 9, wherein the detecting a symbol error rate of a drive signal transmitted to the source drive circuit comprises:

in a blank phase, detecting a symbol error rate of a drive signal transmitted to the source drive circuit;

the adjusting the voltage swing of the drive signal according to the symbol error rate comprises:

in the blank phase, adjusting the voltage swing of the drive signal according to the symbol error rate;

wherein in the blank phase, the source drive circuit is in a hold state, and the source drive circuit controls the display panel to display a previous frame image.

12. The method according to claim 11, wherein before the blank phase ends, the method further comprises:

detecting whether a symbol error rate of the drive signal is greater than a symbol error rate threshold; and when the symbol error rate of the drive signal is greater than the symbol error rate threshold, sending a control signal to the source drive circuit, and continuing to adjust the voltage swing of the drive signal according to the symbol error rate, wherein the control signal is intended to indicate that the source drive circuit is in the hold state in a display phase after the blank phase.

13. The method according to claim 9, wherein the adjusting the voltage swing of the drive signal according to the symbol error rate comprises:

detecting whether the symbol error rate of the drive signal is greater than the symbol error rate threshold; and when the symbol error rate of the drive signal is greater than the symbol error rate threshold, adjusting the voltage swing of the drive signal according to the symbol error rate.

14. A display device, comprising a timing controller;

the timing controller comprises a detection circuit and a control circuit, wherein the control circuit is connected to the source drive circuit, and the detection circuit is connected to the source drive circuit and the control circuit respectively; wherein the control circuit is configured to transmit a drive signal to the source drive circuit;

the detection circuit is configured to detect a symbol error rate of the drive signal;

the control circuit is further configured to adjust a voltage swing of the drive signal according to the symbol error rate detected by the detection circuit, wherein a magnitude of the voltage swing of the drive signal is negatively correlated with a magnitude of the symbol error rate, and the voltage swing of the drive signal refers to the maximum value and the minimum value of a voltage of the drive signal; and wherein the detection circuit is further configured to send the symbol error rate to the source drive circuit, and the source drive circuit is configured to send a hold signal to the control circuit according to the symbol error rate; and the control circuit is further configured to adjust a voltage swing of the drive signal according to a symbol error rate detected by the detection circuit when a potential of the hold signal is an effective potential, and inhibit an adjustment to the voltage swing of the drive signal when a potential of the hold signal is an ineffective potential.

15. The display device according to claim 14, wherein the detection circuit comprises an operation sub-circuit and a counter sub-circuit;

a first input terminal of the operation sub-circuit is connected to an output terminal of the control circuit, a second input terminal of the operation sub-circuit is connected to an input terminal of the source drive circuit, an output terminal of the operation sub-circuit is connected to the counter sub-circuit, and the counter sub-circuit is further connected to an input terminal of the control circuit;

the operation sub-circuit is configured to perform a logic operation on a drive signal outputted from the output terminal of the control circuit and a drive signal received from the input terminal of the source drive circuit, and send an operation result of the logic operation to the counter sub-circuit; and the counter sub-circuit is configured to determine a symbol error rate of the drive signal according to the operation result, and send the symbol error rate to the input terminal of the control circuit.

16. The display device according to claim 14, wherein the control circuit comprises a voltage regulation sub-circuit and a drive sub-circuit; wherein the voltage regulation sub-circuit is connected to the detection circuit and the drive sub-circuit respectively, and the drive sub-circuit is connected to the source drive circuit;

the voltage regulation sub-circuit is configured to adjust an operating voltage applied to the drive sub-circuit according to the symbol error rate, wherein a magnitude of the operating voltage is negatively correlated with a magnitude of the symbol error rate;

the drive sub-circuit is configured to adjust a voltage swing of the output drive signal according to the operating voltage, wherein a magnitude of the voltage swing of the drive signal is positively correlated with a magnitude of the operating voltage.

17. The display device according to claim 16, wherein the voltage regulation sub-circuit comprises a control module, a plurality of resistors connected in series, and a plurality of switching transistors one-to-one corresponding to the plurality of resistors connected in series; wherein the control module is connected to the detection circuit and a gate of each of the switching transistors respectively; one terminals of the plurality of resistors connected in series are connected to a first power supply terminal, and the other terminals of the plurality of resistors in series are connected to a second power supply terminal; a first pole of each of the switching transistors is connected to one terminal of a corresponding one of the resistors, and a second pole of each of the switching transistors is connected to the drive sub-circuit; and the control module is configured to control an operating state of each of the switching transistors according to the symbol error rate.

18. The display device according to claim 17, wherein the voltage regulation sub-circuit comprises a control module, a plurality of resistors connected in parallel, and a plurality of switching transistors one-to-one corresponding to the plurality of resistors connected in parallel; wherein the control module is connected to the detection circuit and a gate of each of the switching transistors respectively; one terminal of each of the plurality of resistors connected in parallel is connected between the first power supply terminal and the second power supply terminal, the first power supply terminal is connected to the second power supply terminal; a first pole of each of the switching transistors is connected to the other terminal of a corresponding one of the resistors, and a second pole of each of the switching transistors is connected to the drive sub-circuit; and the control module is configured to control an operating state of each of the switching transistors according to the symbol error rate.

* * * * *